United States Patent [19]

Schleimann-Jensen

[11] Patent Number: 4,966,078

[45] Date of Patent: Oct. 30, 1990

[54] PROJECTILE STEERING APPARATUS AND METHOD

[76] Inventor: Lars J. Schleimann-Jensen, 182 34 Danderyd, Ekbacksvagen, Sweden

[21] Appl. No.: 456,145

[22] Filed: Dec. 27, 1989

Related U.S. Application Data

[63] Continuation-in-part of Ser. No. 168,850, Mar. 16, 1988, Pat. No. 4,890,554.

[30] Foreign Application Priority Data

Mar. 20, 1987 [SE] Sweden ..... 8701160-7

[51] Int. Cl.[5] ..... F42B 10/64

[52] U.S. Cl. ..... 102/384; 102/388; 244/3.21; 244/3.28

[58] Field of Search ..... 102/384, 388; 244/3.21, 244/3.24, 3.27, 3.28

[56] References Cited

U.S. PATENT DOCUMENTS

| | | | |
|---|---|---|---|
| 2,044,819 | 6/1936 | Taylor | 102/388 |
| 2,424,193 | 7/1947 | Rost et al. | 102/384 |
| 2,425,558 | 8/1947 | Ohlendorf | 102/384 |
| 3,978,790 | 9/1976 | Sandelius | 244/3.27 |
| 4,210,298 | 7/1980 | Liberman | 244/3.21 |
| 4,262,862 | 4/1981 | Hütter | 102/3.29 |
| 4,558,325 | 12/1985 | Ström . | |
| 4,560,121 | 12/1985 | Terp | 244/3.28 |
| 4,568,040 | 2/1986 | Metz | 102/384 |
| 4,624,424 | 11/1986 | Pinson | 102/384 |
| 4,664,339 | 5/1987 | Crossfield | 244/3.28 |
| 4,709,877 | 12/1987 | Goulding | 244/3.28 |
| 4,711,178 | 12/1987 | Argyrakis | 102/384 |

*Primary Examiner*—David H. Brown

*Attorney, Agent, or Firm*—Pollock, Vande Sande and Priddy

[57] ABSTRACT

Projectile steering apparatus and method employing the autogiro principle. Two rotatable blades are swung out from a longitudinal slot in a flying projectile. The blades are shaped to rotate as a result of the air stream rushing past the projectile. Steering is effected by altering the orientation of the blades with respect to the projectile in synchronism with rotation of the projectile. By varying the autogiro pattern produced by the pair of blades, it is possible to impart a force for correcting the projectile trajectory.

5 Claims, 4 Drawing Sheets

FIG.3
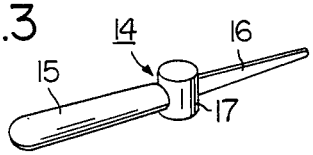
FIG.4a
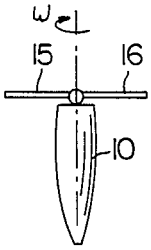
FIG.5a
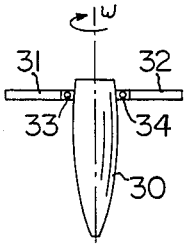
FIG.6a
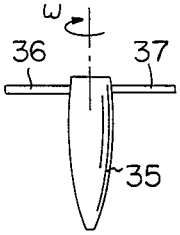
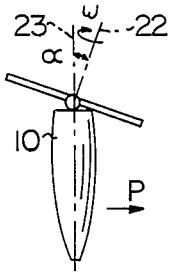
FIG.4b
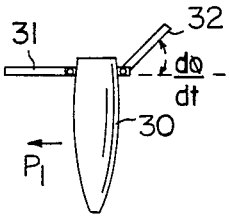
FIG.5b
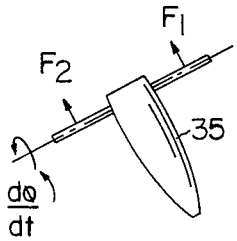
FIG.6b
FIG.7a
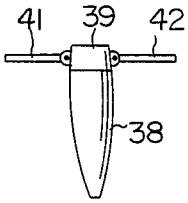
FIG.7b
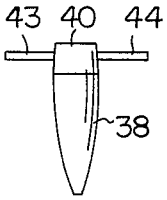

PROJECTILE STEERING APPARATUS AND METHOD

RELATED APPLICATIONS

This is a continuation-in-part of U.S. Pat. Ser. No. 07/168,850, filed Mar. 16, 1988, now U.S. Pat. No. 4,890,554.

The invention relates to a method for guiding a flying object, which travels in a ballistic trajectory, as a projectile, and which is provided with means for guiding the object toward a target by means of a control signal. The control signal can originate from a target seeker situated in the object for measuring the position of a desired target in relation to the trajectory of the object. Alternatively, the flying object can be commando-guided towards the target or be pre-programmed. Furthermore, the invention relates to a projectile steering apparatus for carrying out the method.

Guidance of a projectile towards a target at the end of the trajectory, the so-called final phase guidance, is normally effected by means of conventional guidance fins, to which the control signal is applied. These guidance fins may possibly be combined with or simultaneously serve as roll stabilization fins so that the final phase guidance can be The conventional guidance fins, which do not noticeably influence the speed of the projectile, provide a limited possibility to correct the trajectory in its final phase because the guidance surface of the projectile is limited. In certain cases, there is required a larger correction of the projectile trajectory than can be achieved by means of such guidance fins.

SUMMARY OF THE INVENTION

The object of the present invention is to propose a guidance principle which can be used for final guidance of projectiles, and which enables larger corrections of the trajectory during the final trajectory phase of the same than what is possible with conventional guidance methods.

According to the invention, this is achieved in that during a given point of the trajectory blades or wings are swung out from a longitudinal slot in the flying projectile. The blades are so shaped that they are brought to rotate by their contact with the stream of air past the object, and the blades are adjusted in dependence upon the control signal for guiding the object toward the target.

The blades or wings which are driven by the stream of air according to the so-called autogiro principle, have two effects. First, they will have a braking effect on the projectile so that its speed can be reduced to a value which is proper for the target seeking phase. Additionally, they can be adjusted for imparting to the projectile a controllable lateral force in order to carry out the correction. With suitable dimensioning of the blades and their setting angles, they can be brought to produce an appreciably larger trajectory correction over what can be achieved with conventional guidance fins.

In a first embodiment of the invention, the blades are rotatably journalled on the object, the rotational axis of the blades being adjusted to a given angle relative to the length axis of the object. The object will thus be imparted a lateral force, which is dependent upon the oblique setting of the rotational axis relative to the projectile length axis.

In a second embodiment of the method according to the invention, the blade angle, i.e., the angle between the individual blades and their rotational axis, is varied periodically in synchronization with their rotation in space. The object will thus be imparted a lateral force which is dependent upon the periodic angular variation.

In a further embodiment of the method according to the invention, the angle of incidence of the blades, i.e., the angular position of the individual blades around their own length axis, is varied periodically in synchronism with their rotation in space. In this case, the object is guided in the same manner as a helicopter without driving of the rotor.

A projectile steering apparatus for carrying out the method comprises means for guiding the projectile toward a desired target, in dependence upon a control signal. The means comprises blades or wings which, in a first phase of the trajectory, are situated within the projectile, and which can be swung out in a given point of the trajectory, and then are so shaped that they are brought to rotate by their contact with the stream of air along the projectile. Actuation means are furthermore arranged for adjusting the blades in dependence of the control signal for guiding the projectile toward the target. These activation means may be implemented to carry out the function of steering the projectile by varying the lateral force applied to the projectile.

The first of these embodiments may be implemented by utilizing a motor driven link arm assembly which varies the angle between the axis of rotation of the rotor blades and the projectile longitudinal axis.

The second embodiment may employ a linear actuator which will apply force to one end of one of the two blades which form the rotor. The angle of the blade with respect to the projectile axis is varied periodically by the actuator, synchronized with respect to the projectile angular rotation. The result is the generation of a lateral force on the projectile in a direction which is controllable by changing the phase of the periodic angular displacement with respect to the angular rotation of the projectile. This produces a non-symmetrical power pattern having a lift or force component for effecting steering of the projectile.

In a third embodiment of the invention, the rotor blades maintain a substantially constant rotational angle with regard to the projectile horizontal axis. The tilt angle of at least one of the blades are driver changed in synchronism with the projectile rotation. This produces different lift forces on the projectile, which effectively steers the projectile.

The invention is illustrated by means of example with reference to the accompanying drawings.

DESCRIPTION OF THE FIGURES

FIG. 3 illustrates a perspective view of an embodiment of the rotor.

FIGS. 4A and 4B illustrate, by means of schematic side views, the principle for guiding the projectile toward the target, the same projectile of the embodiment shown in FIGS. 1 and 2.

FIGS. 5A and 5B illustrate the principle of steering as carried by by a second embodiment of the invention.

FIGS. 6A and 6B illustrate the principle of steering as carried out by a third embodiment of the invention.

FIGS. 7A and 7B illustrate a fourth embodiment of the invention, permitting steering to be carried out.

DESCRIPTION OF THE PREFERRED EMBODIMENT

Figure 1:
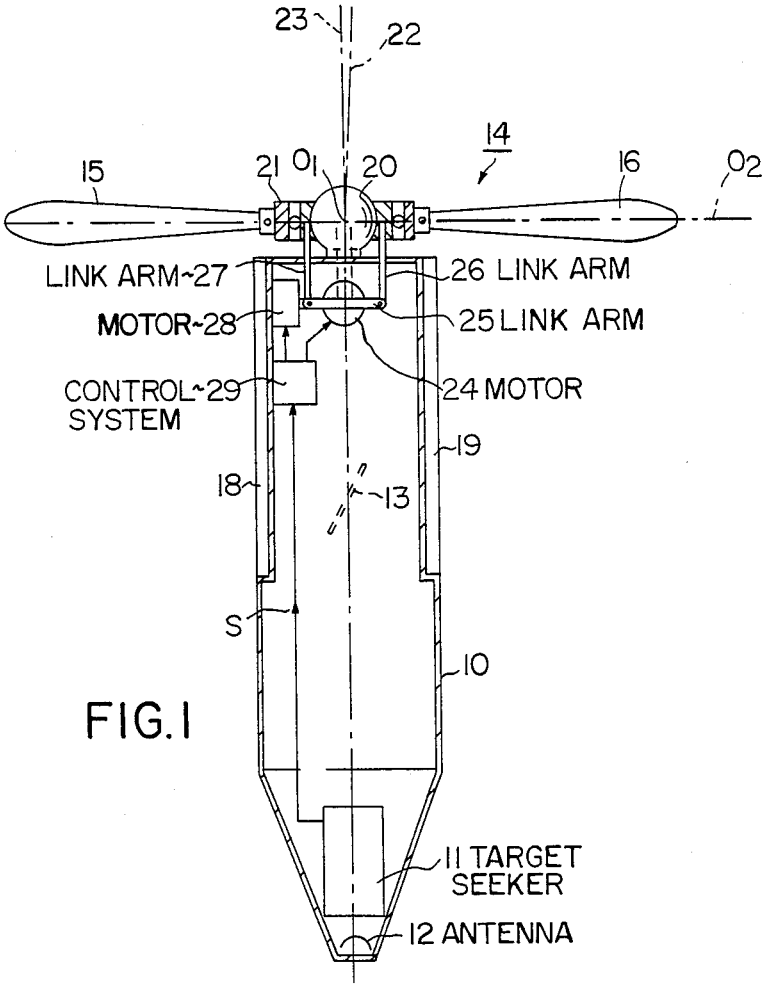
FIG. 1 shows a side view of a projectile comprising a rotor for guiding the projectile toward a target with utilization of the autogiro principle in accordance with the invention.
Figure 2:
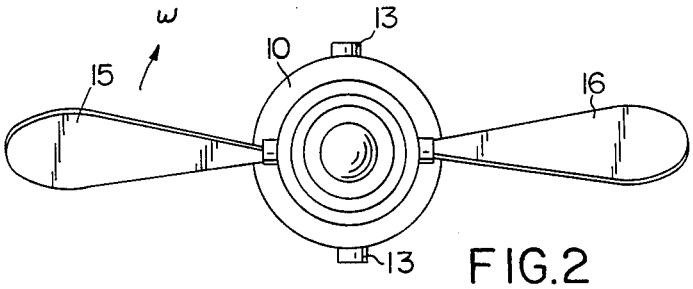
FIG. 2 shows a rear view of the same projectile.

In FIGS. 1 and 2, reference numeral 10 designates a projectile body which, at its nose, has a target seeker 11, with antenna 12, and which is provided with roll stabilization fins 13. At the rear portion of the projectile, there is a rotor 14 including two rotor blades 15, 16. In the embodiment shown in FIG. 3, the rotor blades are interconnected via a hub 17. The rotor blades 15, 16 are pivotally mounted and can be swung forward so that they are hidden in slots 18, 19 in the side of the projectile body. Locking means retain the rotor blades in the hidden position. The locking means can be influenced by a release mechanism for releasing the rotor blades so that they are swung out to the shown position. In this position, the rotor blades have a fixed angular position relative to the hub and, according to FIG. 3, are oblique in the same manner as a propeller. The rotor is journalled on a ball 20 by means of a ball bearing 21, so that it can rotate about a rotational axis 22 and can vary its rotational axis relative to the projectile axis 23. Adjustment of the rotational axis 22 is effected by turning the whole rotor about two mutually perpendicular axes $O_1$. and $O_2$. Angular setting about the first axis $O_1$ is effected by means of an electric motor 24, which is coupled to the inner ball bearing ring by a mechanical link system comprising link arms 25, 26, 27. Angular setting about the second axis $O_2$ is effected by means of an electric motor 28, which is coupled to the inner ball bearing ring by a similar link system. The link transmission can be of the same embodiment as that described in the Swedish Pat. No. SE 8106754-8, corresponding to U.S. Pat. No. 4,558,325.

The drive currents to the motors 24, 28 are obtained from a control system 29, which in turn obtains a control signal S from the target seeker 11. By turning the rotor about the two axes $O_1$ and $O_2$, the rotor shaft is then set in an angle relative to the length axis of the projectile that the projectile is imparted a force in such direction, in which the projectile trajectory is displaced in direction toward the desired target. This is illustrated in FIG. 4A which shows the projectile with the rotor blades 15, 16 released, but without oblique setting of the rotor axis. The projectile in this case is not influenced by any lateral force, and the rotor has only a braking effect. In FIG. 4B, the rotor axis 22 has been set in an angle relative to the length axis 23. The projectile will now be imparted a force in the direction indicated by the arrow P and, besides its motion in the length direction, will consequently move in the direction P. By proper setting of the angle, any error of the projectile trajectory can be corrected, so that the projectile hits the target.

The function, after firing the projectile in conventional manner with the rotor blades hidden in the projectile body, is that the locking means of the rotor blades are influenced during a suitable point of the projectile trajectory so that the rotor blades are swung out to the shown position, and the target seeker is activated. The release of the rotor blades can be effected on a time basis, as counted from the firing moment or by means of a signal from a distance sensor or the like. By cooperation with the stream of air passing along the projectile, the rotor is put into rotation and the projectile is braked to an angular speed W, which is suitable for target seeking and final phase guidance. When the target seeker has found the desired target, it delivers such control signals S to the drive stages of the electrical motors that the projectile is guided toward the target by the oblique setting of the rotor.

FIGS. 5A and 5B illustrate another principle for autogiro guidance according to the invention. The rotor blades 31, 32 are fastened directly to the rotor body 30 which is not roll stabilized. The rotor blades shaped as a propeller then will maintain a rotation w of the projectile body, after braking the same to a speed which is suitable for final phase guidance. The rotor blades are mounted so as to be pivotal about two axes 33, 34 which are perpendicular to the length axis of the projectile in order that the blade angle, i.e., the angle between the length axis of the blade and the rotational axis, can be varied. Within the projectile there are adjustment means whereby each rotor blade in each moment can be adjusted individually to each desired blade angle. For final phase guidance of the projectile, the blade angle is then varied periodically as $d\phi/dt$ with the rotation of the projectile in such manner that each blade is swung backwardly when it passes a given part of the revolution, as seen in space, as shown in FIG. 5B. A force will act upon the projectile in a direction indicated by the arrow $P_1$. Along with its motion in the length direction, the projectile will consequently move in a lateral direction.

A further embodiment of autogiro guidance in accordance with the invention is shown in FIGS. 6A and 6B. The rotor blades 36, 37 in this embodiment are fastened directly to the projectile body 35 and the projectile is not roll stabilized. The rotor blades are now adjustable regarding their angle of incidence, i.e., the angle about their own length axis, and cooperate with adjustment means, whereby the angle of incidence can be varied periodically $d\phi/dt$ in synchronism with the rotation, in the same manner as in a helicopter. Different large braking forces will act upon the rotor blades in different points of the revolution dependent upon the instantaneous angle of incidence at this position, as illustrated by the arrows $F_1$ and $F_2$ in FIG. 6B, and the projectile will make a tipping motion and move in a lateral direction.

Figure 8A:
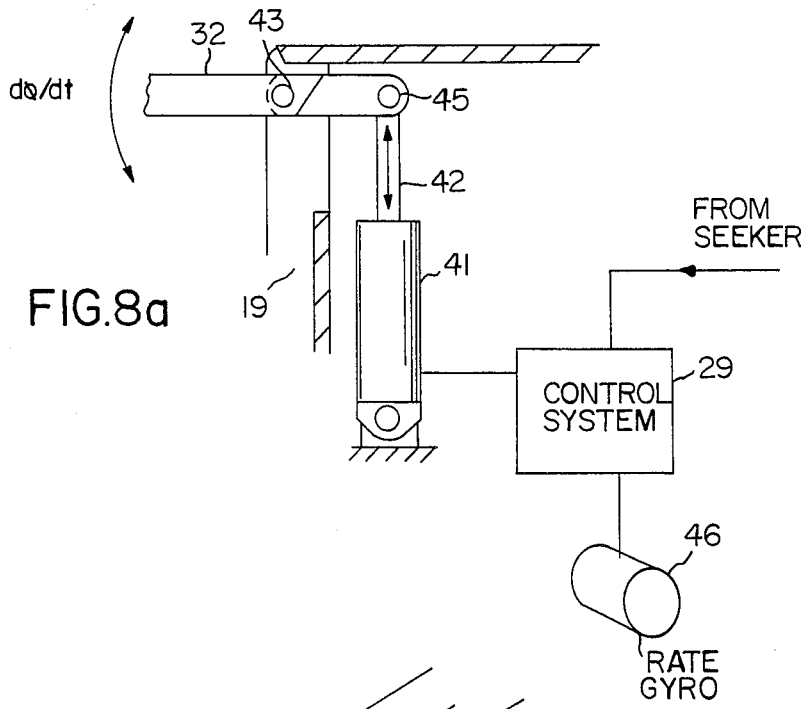
FIG. 8A illustrates an apparatus for varying the blade axis of one of the two blades with respect to the projectile axis.

Apparatus for implementing the steering techniques illustrated in FIGS. 5A and 5B is shown in FIG. 8A. As can be seen in this Figure, a conventional rate gyro 46 provides projectile rotational information to a control system 29. Additionally, the seeker provides trajectory error signals to control system 29. From the signals received from the rate gyro 46 and seeker 11, the control system derives a control signal for linear actuator 41. Linear actuator 41 includes an actuating arm 42 which moves inwardly and outwardly in response to an applied control signal.

Figure 8B:
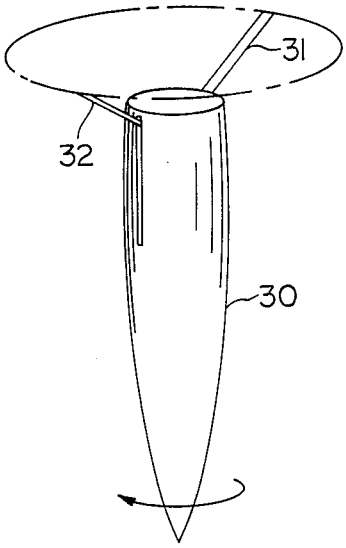
FIGS. 8B and 8C illustrate the effect of varying the blade axis on the power pattern produced by the apparatus of FIG. 8A.
Figure 8C:
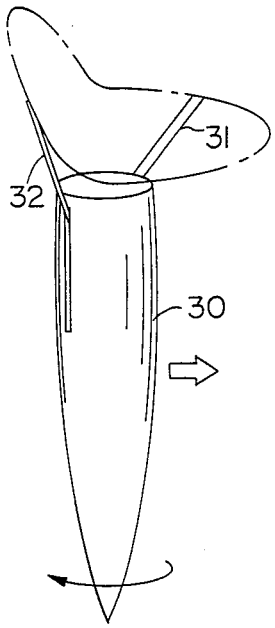

The blade 32 is shown pivoted around a pivot support 43 and connected at one end to the actuating arm 42 by a connecting element 45. The control system 29 will provide a time varying control signal to the linear actuator 41 in synchronism with the projectile 10 rotation. By imparting an angular displacement $d\phi/dt$ to the blade 32, a power pattern is produced, as is shown in FIGS. 8B and 8C. A similar structure may be implemented to vary the position of blade 31.

FIG. 8B illustrates the condition wherein the projectile 30 does not require any correction to its trajectory, and the blades 31 and 32 axes are held in substantially constant relationship to the projectile axis.

FIG. 8C illustrates the effect of processing rotor blade 32 about an angle on a periodic basis. The power pattern produces a lateral force which is shown moving the projectile to the right of its axes.

This synchronization with respect to the rotation of projectile 30 controls the direction of the force applied to the projectile. It is clear that as the periodic signal driving the actuator 41 and blade 32 is phase shifted with respect to the rotation of the projectile 30, the force can be shifted as well, thus steering the object toward a desired trajectory.

Figure 9A:
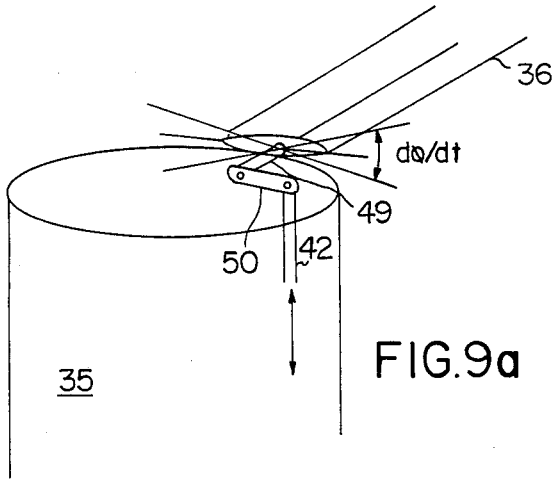
FIG. 9A illustrates an apparatus for varying the angle of one of the rotating blades about a constant rotational axis for the blades.

FIG. 9A illustrates apparatus which can be used to implement the steering technique illustrated in FIGS. 6A and 6B. The blade 36 is shown supported by an axle 49. Axle 49 is connected at one end thereof to a linkage arm 50. Linkage arm 50 is connected to the arm 42 of a linear actuator, substantially the same as that shown in FIG. 8A. A similar structure my be implemented to rotate blade 37.

It is therefore clear that the angle $d\phi/dt$ describing the angle between the plane of rotor blade 36 and a reference axis may be controlled by the linear actuator 42.

Figure 9B:
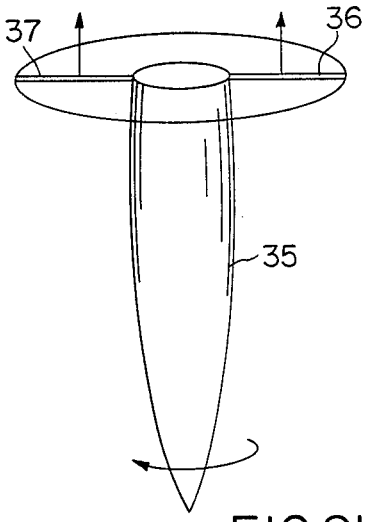
FIGS. 9B and 9C illustrate the effect of changing the rotating blade angle of incidence on the power pattern produced by the apparatus of FIG. 9A.
Figure 9C:
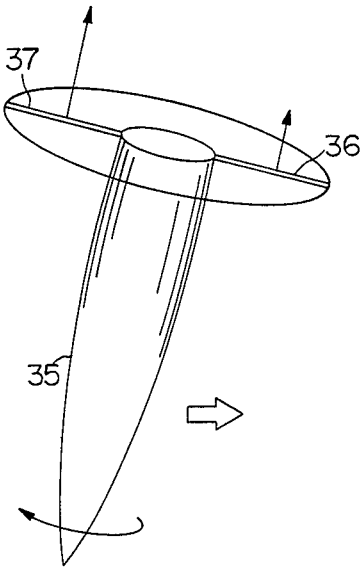

Referring specifically to FIGS. 9B and 9C, the effect may be seen of controlling the angle $d\phi/dt$ for the blade 36. In FIG. 9B, there is shown a projectile 35 following a desired trajectory. When the projectile 35 is to be steered, rotation of the blade 36 about an angle $d\phi/dt$ will likewise vary the power pattern produced by rotation of blades 36, 37. This particular steering technique, as previously noted, is used in helicopter steering mechanisms for positioning the aircraft at an angle to the axis of rotation for the rotor blades. As was true in the previous embodiment, the rotation of the blade about its longitudinal axis is done on a periodic basis, in synchronism with the rotation of the projectile 35. This permits varying the direction of the force imparted to the projectile 35 by changing the relative phase of the periodic displacement of the blade 36 about its axis, as referenced to the rotation of projectile 35.

Variants on the last two embodiments are shown in FIGS. 7A and 7B. In this case, the main part 38 of the projectile body is roll stabilized and has at its rear part a section 39 and 40, respectively, which is rotatable relative to the main body, and which supports the rotor blades 41, 42 and 43, 44, respectively. In FIG. 7A, the rotor blades 41, 42 are adjustable regarding their blade angle, and in FIG. 7B, the rotor blades 43, 44 are adjustable regarding their angle of incidence. The blade angle or angle of incidence is varied periodically during the revolution in the same manner as in FIGS. 5 and 6, respectively, and final phase guidance is effected in previously described manner.

A number of modifications of the described embodiments are possible within the scope of the invention. Thus, the air driven rotor does not need to be situated at the rear part of the projectile, but may situated at the middle of the projectile. In the transport position and during firing of the projectile, the rotor blades can also be swung backward instead of forward, as in the shown example. Instead of using one single rotor, two counter-rotating rotors can be arranged. In certain guidance situations, in particular when guiding the projectile towards flying objects, the guidance may be based upon the fact that a variation of the rotational axis of the rotor blades will vary the angle of incidence of the projectile itself, i.e., the angle between the length axis of the projectile and the direction of the meeting air stream, and thereby influence the trajectory.

Thus, there has been described a number of embodiments of the claimed invention, which are further described by the claims which follow.

What is claimed is:

1. An apparatus for steering a projectile comprising:

a seeker for deriving an error signal identifying an error between a trajectory of said projectile and a desired trajectory;

a pair of rotor blades supported on a rear section of said projectile, said rotor blades rotating with said rear section;

means connected to said rotor blades for varying the angular position of said blades with respect to said projectile longitudinal axis in synchronism with rotation of said rear section, whereby a non-symmetrical power pattern is produced by said rotor blades, imparting a steering force to said projectile; and control system means connected to said seeker for receiving said error signal, and for providing a control signal to said means for varying the angular position of said blades for producing a period variation of said blade position, whereby a force is applied to said projectile in a direction for reducing said error.

2. The apparatus of claim 1 wherein said means for varying the angular position of said blades comprises:

a linear actuator connected to said rear section, having an actuating arm connected to one end of one of said rotor blades; and, a pivot means located between said one end of said one rotor blade and a remaining end, permitting said one rotor blade to be angularly positioned with respect to said projectile axis.

3. An apparatus for steering a projectile comprising:

a seeker for deriving an error signal identifying an error between a trajectory of said projectile and a desired trajectory;

a pair of rotor blades supported on a rear section of said projectile, said rotor blades rotating with said rear section;

means connected to said rotor blades for rotating said rotor blades about their longitudinal axes while maintaining said longitudinal axis fixed with respect to said projectile longitudinal axis, whereby a lateral force may be imparted to said projectile for reducing said error; and, a control system connected to said seeker and to said means for rotating said rotor blades for providing a signal for rotating said rotor blades in synchronism with rotation of said axis, to create a power pattern from said rotor blades which applies a lateral force to said projectile in a direction which reduces said error.

4. The apparatus of claim 3 wherein said means for rotating said rotor blades comprises:

an axle connected to one of said rotor blades supporting said rotor blade for rotation along a longitudinal axis;

a linkage arm having one end connected to said blade, and a second end for receiving a force for rotating said axle and connected blade; and, a linear actuator having an actuating arm connected to said linkage arm second end, receiving a signal from said control system which rotates said blades in synchronism with said projectile rotation.

5. A method for steering a projectile comprising:

providing at a rear of said projectile a pair of rotor blades which rotate with said projectile, and which are angularly displaceable from the longitudinal axis of said projectile;

determining a trajectory error for said projectile; and, varying the angular position of said blades with respect to the longitudinal axis of said projectile in synchronism with rotation of said projectile, whereby said rotor blades generate a power pattern which produces a lateral force on said projectile in a direction to reduce said trajectory error.

* * * * *